US010208435B2

(12) United States Patent
Stallgies et al.

(10) Patent No.: US 10,208,435 B2
(45) Date of Patent: Feb. 19, 2019

(54) ATTACHMENT SCREED UNIT FOR A ROAD PAVER AND ROAD PAVER HAVING SUCH AN ATTACHMENT SCREED UNIT

(71) Applicant: BOMAG GmbH, Boppard (DE)

(72) Inventors: Lutz Stallgies, Bassenheim (DE); Jens Wagner, Langenthal (CH); Thomas Zahr, Pulheim (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/717,363

(22) Filed: May 20, 2015

(65) Prior Publication Data

US 2015/0337505 A1 Nov. 26, 2015

(30) Foreign Application Priority Data

May 20, 2014 (DE) ..... 10 2014 007 399

(51) Int. Cl.
*E01C 19/40* (2006.01)
*E01C 19/48* (2006.01)

(52) U.S. Cl.
CPC ..... *E01C 19/40* (2013.01); *E01C 19/48* (2013.01); *E01C 2301/14* (2013.01)

(58) Field of Classification Search
CPC ..... E01C 19/004; E01C 19/42
USPC ..... 404/118
See application file for complete search history.

(56) References Cited

U.S. PATENT DOCUMENTS 3,602,115 A * 8/1971 Hanson ..... E01C 19/008 404/105
3,738,763 A * 6/1973 Glesmann ..... E01C 19/29 404/119

(Continued)

FOREIGN PATENT DOCUMENTS

CN 2651292 Y 10/2004
CN 103469722 A 12/2013

(Continued)

OTHER PUBLICATIONS

Espacenet, English Machine Translation of Abstract of EP2377998A2, published Oct. 19, 2011, retrieved from http://worldwide.espacenet.com on May 13, 2015 (1 page).

(Continued)

*Primary Examiner* — Thomas B Will
*Assistant Examiner* — Katherine J Chu
(74) *Attorney, Agent, or Firm* — Wood Herron & Evans LLP

(57) ABSTRACT

The present invention relates to an attachment screed unit for a road paver, comprising a connecting screed, at least one adjusting screed which is adjustably mounted on the connecting screed and which is adjustable between a retracted position ($P_1$) and an extended position ($P_2$), as a result of which the paving width ($b_4$) of the attachment screed unit can be set in a variable manner, and a hydraulic adjusting device, which is arranged in such a manner that it can adjust the at least one adjusting screed between the retracted position ($P_1$) and the extended position ($P_2$), the adjusting device comprising an electro-hydraulic unit which is arranged on the attachment screed unit (10), and the electric hydraulic unit comprising a separate hydraulic circuit with at least one hydraulic pump and an actuator. The present invention further relates to a road paver with such an attachment screed unit.

15 Claims, 4 Drawing Sheets

(56) References Cited

U.S. PATENT DOCUMENTS 4,682,908 A * 7/1987 Domenighetti ..... E01C 19/40 404/118
5,299,857 A * 4/1994 Zanetis ..... E01C 23/088 111/101
6,116,006 A * 9/2000 Killen ..... A01D 57/20 56/11.9
6,190,087 B1 * 2/2001 Rower ..... E01C 19/40 403/31
7,497,244 B2 * 3/2009 Hovestadt ..... B22D 11/053 164/416
2002/0044831 A1 * 4/2002 Leone ..... E01C 19/42 404/104
2006/0013654 A1 * 1/2006 Barthel ..... E01C 19/43 404/122
2007/0258769 A1 * 11/2007 Eppes ..... E01C 19/48 404/118
2010/0284742 A1 * 11/2010 Christ ..... E01C 19/48 404/118
2011/0094280 A1 * 4/2011 Jamet ..... B30B 15/16 72/28.1
2011/0107983 A1 * 5/2011 Magro ..... F01N 3/04 123/41.1
2014/0186115 A1 * 7/2014 Graham ..... E01C 19/4873 404/75
2014/0219721 A1 * 8/2014 Ellwein ..... E01C 19/48 404/83
2014/0294503 A1 * 10/2014 Ramos ..... E01C 19/42 404/118
2014/0301784 A1 * 10/2014 Kopacz ..... E01C 19/48 404/118
2014/0363230 A1 * 12/2014 Buschmann ..... E01C 19/42 404/72
2015/0003914 A1 * 1/2015 Steinhagen ..... E01C 19/48 404/118
2015/0063907 A1 * 3/2015 Graham ..... E01C 23/07 404/84.1

FOREIGN PATENT DOCUMENTS

DE 10 2013 000 788 A1 7/2014
EP 2 377 998 A2 10/2011

OTHER PUBLICATIONS

Espacenet, English Machine Translation of Abstract of DE102013000788A1, published Jul. 17, 2014, retrieved from http://worldwide.espacenet.com on May 13, 2015 (1 page).

* cited by examiner

ATTACHMENT SCREED UNIT FOR A ROAD PAVER AND ROAD PAVER HAVING SUCH AN ATTACHMENT SCREED UNIT

CROSS-REFERENCE TO RELATED APPLICATION

The present application claims priority under 35 U.S.C. § 119 of German Patent Application No. 10 2014 007 399.8, filed May 20, 2014, the disclosure of which is hereby incorporated herein by reference in its entirety.

FIELD OF THE INVENTION

The present invention relates to an attachment screed unit for attachment to a screed unit of a road paver and a road paver having such an attachment screed unit. The attachment screed unit specifically comprises a connecting screed and at least one adjusting screed adjustably mounted on the connecting screed, which adjusting screed can be adjusted between a retracted position and an extended position, as a result of which the paving width of the attachment screed unit is variable, and a hydraulic adjusting device which is arranged in such a manner that it can adjust the at least one adjusting screed between the retracted position and the extended position.

BACKGROUND OF THE INVENTION

Generic self-propelled road pavers mostly comprise an internal combustion engine such as a diesel engine, a machine frame, a chassis, running gears such as wheels or crawler tracks, a operator platform and devices for laying and paving asphalt or concrete in subbase covers or layers on the ground. In operation, asphalt which is still hot, for example, is transferred from a transport vehicle to a material bunker or bin arranged in the front of the road paver in the travelling direction and is conveyed from there via transport devices such as scraper floors through the so-called tunnel to the rear of the road paver. The asphalt is distributed from here via suitable transverse distribution apparatuses such as screw conveyors over the paving width of the so-called paving screed. The working direction designates the direction in which the road paver moves during working operation, i.e., during the paving of paving material. The known paving screeds can be provided for fixed paving widths, so-called rigid screeds, or they can be variable with respect to the paving width by means of transversely displaceable screed elements. A rigid screed is a screed device on the road paver which does not allow any variable adjustment of the paving width. The so-called basic screed, i.e., the screed which is mounted directly by respective retaining arms on the tractor of the road paver, is usually a rigid screed. A screed unit of variable working width is disclosed, for example, in DE 60 2004 009 416 T2, which discloses displaceable screeds arranged on a rigid screed as a constructional overall module. It is further known to broaden rigid screeds in sections by means of attachment screeds also having a fixed paving width. The material that is placed and distributed on the ground is compacted and smoothed by the paving screed. Compacting units are frequently provided for this purpose on the screed, e.g., a tamping beam and a smoothing screed with vibrators, which, optionally in combination with further levelling strips, produce a smooth and pre-compacted paving material layer, for example, an asphalt layer. Floating on the ground material, the paving screed is drawn behind the tractor during paving operation.

Portions of the screed may be heated in order to prevent adherence of paving material. High-compaction screeds are also known, on which additional pressure bars can be provided in front of or behind the smoothing screed. Since these devices need to process the distributed paving material in a predetermined sequence, the screed has a defined orientation during operation of the road paver, and, therefore, the screed also has a working direction which corresponds to the working direction of the road paver. Such road pavers and paving screeds are known, for example, from DE 10 2013 000 788.7 of the Applicant, as well as EP 2 377 998 A2 and DE 60 2004 009 416 T2.

It frequently occurs in practice that surfacing and base layers of different widths need to be paved by one and the same road paver. The two aforementioned approaches are principally known for widening the paving screed. On the one hand, the paving width of the road paver can be increased in that further attachment segments or attachment screeds are mounted at the ends of the screed situated transversely to the working direction, via which attachments all devices of the screed, i.e., the transport device for the paving material as well as potential vibration or tamping beams, are extended. The paving width of the road paver, or the paving screed, extends in fixed steps by the width of the attachment element. The advantage of this solution is that, in terms of construction, the individual screed elements can usually be arranged in a relatively simple manner. A disadvantage, however, resides in the fact that the available paving width can only be varied by fixed intervals. If the operator wishes to cover a wide spectrum of paving widths, he will need to keep a large number attachment screeds of different widths on stock. Such road pavers are frequently used with very large paving widths, as are required for highways, for example. Obstructions can, however, occur in such construction sites, especially in the region of the side edges, which require width adjustment, for example, by means of temporary removal of an attachment screed segment. A further possibility to vary the paving width of the road paver is to provide hydraulically driven extension screeds on the lateral outer ends of the screed transversely to the working direction, which extension screeds can be retracted or extended transversely to the working direction of the road paver relative to the screed either by the driver of the road paver or by operators situated on the side of the screed. The placing width of the road paver can, for example, be varied continuously within a fixed range by means of these extension screeds which are mostly operated hydraulically, as a result of which narrowing or widening sections of a base course can be paved. The hydraulic extension screeds are also used for compensating fluctuations in the width to be paved, for example, during paving a curve of a road, and for working around potential obstructions during the paving. The advantage of these extension screeds is that it is possible to respond in a substantially more precise manner to changing paving widths. Disadvantages, however, reside in the often considerable constructive effort and the higher production and maintenance costs. Furthermore, these arrangements are frequently not suitable for large paving widths. The hydraulic extension screeds are pressurised and operated by a hydraulic pump, which is typically provided on the road paver, by means of a hydraulic fluid such as hydraulic oil. For this purpose, hydraulic lines are laid from the extension screed via the further screed parts up to the road paver, which lines connect the actuators of the extension screeds to the hydraulic system of the road paver. These hydraulic lines are connected via quick-action couplings both to the hydraulic system of the road paver and also to the actuators of the extension screeds, so that the hydraulic fluid of the hydraulic system of the road paver can flow through the lines up to the actuators of the hydraulic extension screed and back again. A connection to the hydraulic system of the road paver thus usually occurs in the prior art.

This is disadvantageous in that the connection to the hydraulic system of the road paver is complex and time-consuming. In addition, the repeated connection of different hydraulic lines of all attachment segments of a screed to the hydraulic system of the road paver leads to increased contamination of the hydraulic fluid of the road paver, which negatively affects the overall system. Furthermore, the laying of hydraulic lines through all segments of the screed, even those which do not require any hydraulic energy, leads to increased construction costs.

It is thus the object of the present invention to provide a solution for obtaining a variable paving width of a screed device of a road paver at the lowest possible manufacturing and reconfiguration costs. A solution shall further be provided for obtaining, if necessary, a variable width adjustment in a simple manner and without considerable modification efforts in road pavers which are exclusively equipped with rigid screeds, as are used, for example, for large paving widths.

SUMMARY OF THE INVENTION

A basic concept of the present invention is arranging an attachment screed unit per se as an overall element or module which is variable in its paving width without the need to produce a hydraulic fluid supply to the tractor of the road paver. To this end, the attachment screed unit according to the present invention for attachment to a screed unit of a road paver comprises a connecting screed, at least one adjusting screed which is adjustably mounted on the connecting screed and which is displaceable between a retracted position and an extended position relative to the connecting screed, which results in a variable paving width of the attachment screed unit, and a hydraulic adjusting device which is arranged in such a manner that it can adjust the at least one adjusting screed between the retracted position and the extended position, ideally in a continuous manner, wherein the adjusting device comprises an electro-hydraulic unit which is arranged on the attachment screed unit and which comprises an electric connection via which the electro-hydraulic unit can be supplied with electrical power, and wherein the electro-hydraulic unit comprises a separate hydraulic circuit with at least one electrically driven hydraulic pump and a hydraulic actuator driven by the hydraulic pump. The attachment screed unit thus always comprises two individual screed elements, which have further functions in addition to the pure screed functions for the paving process. On the one hand, the connecting screed represents the screed element via which the screed unit according to the present invention is always mounted or fixed to a screed, especially a rigid screed, of the road paver instead of being linked, directly or via respective retaining arms, to the tractor of the road paver. On the other hand, the connecting screed is also the support element for the adjusting screed. The adjusting screed is thus adjustably mounted, and especially displaceably mounted, on the connecting screed in such a manner that the total paving width of the attachment screed is adjustable within a fixed range (depending on the embodiment, principally by not more than from maximally the width of the connecting screed and the adjusting screed up to minimally the width of the respectively wider adjusting screed or connecting screed). The adjustment occurs via a hydraulic adjusting device, for example, using a hydraulic linear actuator, etc.

What is essential here is that the adjusting device, as a part of the attachment screed unit, comprises an electro-hydraulic unit, and that the electro-hydraulic unit comprises a separate hydraulic circuit with at least one hydraulic pump and an actuator. The drive and the actuation of the width adjustment are, therefore, integrated in the attachment screed unit and are mounted and dismounted together with the latter as a unit. As a result, especially for adjustment of the adjusting screed relative to the connecting screed of the attachment screed unit, there is no fluid exchange with the hydraulic system of the road paver itself, which is supplied with drive power by the internal combustion engine.

According to the present invention, an electro-hydraulic unit comprises at least one fluid reservoir and a hydraulic pump which is driven electrically, for example, by means of an electric motor, and to which an actuator is connected for adjusting the adjusting screed relative to the connecting screed. The electric motor for the hydraulic pump can be arranged separately or as a modular motor-pump assembly. The electro-hydraulic unit comprises a separate hydraulic circuit which is independent of the hydraulic circuit of the road paver. The hydraulic circuit of the road paver is the hydraulic circuit which supplies power to further devices arranged on the road paver, for example, scraper floors in the bunker and in the tunnel, foldable side walls of the bunker, and/or the running gears.

According to the present invention, the hydraulic circuit of the road paver can supply hydraulic power to, or drive, all hydraulic devices of the road paver with the exception of the adjusting device of the attachment screed unit according to the present invention. The adjusting device of the attachment screed unit on the other hand is not driven by the hydraulic circuit of the hydraulic system of the road paver, but by a separate hydraulic circuit integrated in the attachment screed unit. Any parts of the road paver, other than the screed, belong to what is also designated as the tractor. In the present context, the hydraulic circuit of the hydraulic system of the road paver designates a hydraulic circuit which is arranged at least partly on the tractor. The hydraulic circuit of the attachment screed unit, or the electro-hydraulic unit, according to the present invention, which is separate therefrom, is not arranged on the tractor, especially not with any component. It should be noted, however, that an electrical contact with the tractor is still possible as an electric connection is not a part of the hydraulic circuit as defined.

A fundamental idea of the present invention is, therefore, to completely arrange the electro-hydraulic unit in accordance with the present invention, including the hydraulic pump and the electric drive, on the attachment screed unit. In particular, there shall be complete separation between the hydraulic system of the tractor and the hydraulic circuit of the electro-hydraulic unit. Accordingly, there is also no fluid connection between the hydraulic circuit of the electro-hydraulic unit and the hydraulic circuit of the tractor. The electro-hydraulic unit rather comprises a separate hydraulic fluid storage unit or a separate hydraulic fluid reservoir, from which a hydraulic fluid, for example, hydraulic oil, is conveyed from the hydraulic pump of the electro-hydraulic unit to the actuator for adjusting the adjusting screed relative to the connecting screed, and returns from there to the fluid reservoir. It is, however, also possible to provide the electro-hydraulic unit with a closed hydraulic circuit in which no fluid reservoir is provided, but wherein the hydraulic fluid is guided directly back to the hydraulic pump. Leakage losses can then be compensated, for example, by a further pump, which is ideally also a part of the attachment screed unit. Mixing of the hydraulic fluid of the electro-hydraulic unit with the hydraulic fluid of the hydraulic system of the tractor is thus excluded. The actuator, which is supplied with pressurized hydraulic fluid by the hydraulic pump, adjusts the at least one adjusting screed between the retracted position and the extended position and thus ensures an adjustment of the paving width of the attachment screed unit. The present invention ensures that complex hydraulic lines are no longer required between the attachment screed unit according to the present invention and the tractor. This leads both to cost reductions and also to a reduced need for space in the areas of the screed in which hydraulic lines usually need to be laid in the prior art. Furthermore, installation and removal is considerably facilitated. The advantages of the present invention are provided especially when the attachment screed according to the present invention is connected via rigid intermediate screeds to a basic screed. Especially with this arrangement, considerable distances had hitherto to be bridged via suitable hydraulic lines. This can now be dispensed with using the attachment screed according to the present invention as the electro-hydraulic unit of the attachment screed unit according to the present invention is autonomously separate from the hydraulic system of the tractor of the road paver.

For the power supply of the attachment screed unit according to the present invention, an electric connection and a line are provided on the electro-hydraulic unit, via which the electro-hydraulic unit can be supplied with electrical power. The electrical power is used among other things for operating the hydraulic pump or the electric motor of the hydraulic pump and optionally its controller. It is possible, for example, to lay an electric line, especially in form of a cable, from the electro-hydraulic unit to the road paver (tractor), by means of which the electro-hydraulic unit can be connected to the electrical on-board network of the road paver. The attachment screed unit according to the present invention thus, preferably, receives the electrical power of the electro-hydraulic unit from the road paver (tractor), especially from its on-board network. For this purpose, the attachment screed unit can comprise an electric line such as a cable reel or a cable drum which is stored in a space-saving manner and which can be unrolled by an operator in a rapid and easy manner and can be used for establishing electric contact with the on-board network of the tractor. The power connection of the attachment screed unit or the electro-hydraulic unit therefore occurs in a rapid and easy manner according to the present invention by means of conventional plug connections. Contamination of the hydraulic fluid of the tractor can be prevented reliably by using electrical power of the tractor instead of hydraulic energy as in the prior art, and a power supply is obtained which is easy to produce and operates reliably. As a result, the operator of the road paver can attach the attachment screed unit according to the present invention in a rapid and easy manner to a screed of the road paver and can thus rapidly obtain the advantages of a variable paving width, even in case of road pavers which are initially merely equipped with one or several rigid screeds.

It is, alternatively, also possible that the electro-hydraulic unit uses a power source for the supply with electrical power which is separate from the tractor, especially a battery or a power source which is external from the road paver. The power source is then preferably directly arranged on the attachment screed unit and is, in particular, connected thereto in an exchangeable manner. The power source supplies the electro-hydraulic unit, in particular, the hydraulic pump or its electric motor, and a control device, if necessary, with electric power. In this case, it is no longer necessary to produce a power connection between the electro-hydraulic unit and the tractor. The attachment of the attachment screed unit to the road paver or the screed of the road paver is thus limited to merely mechanical mounting for the attachment of the attachment screed unit per se, without providing an additional electrical or hydraulic connection to the hydraulic system or the on-board network of the road paver (tractor). In this case, it is possible that the electro-hydraulic unit operates absolutely independently of the road paver with respect to power.

In order to adjust the adjusting screed transversely to the operating direction of the attachment screed unit or the road paver, it is, particularly, preferred if the actuator is a linear drive, especially a double-acting hydraulic cylinder or a hydraulically driven rack-and-pinion drive. If a hydraulic cylinder is used, it is sufficient if the electro-hydraulic unit comprises a hydraulic pump. The hydraulic cylinder can be driven directly by the hydraulic pump. If a double-acting hydraulic cylinder is used, the adjusting screed can be adjusted actively in two directions. When using a rack-and-pinion drive, it is necessary that the electro-hydraulic unit additionally comprises a hydraulic motor which is driven by the hydraulic pump and which transmits a rotational movement onto the rack-and-pinion drive. It is preferred if the hydraulic motor is reversible and the rack-and-pinion drive can thus be operated in two directions, as a result of which the adjusting screed can be adjusted actively in both directions between the extended position and the retracted position.

Different stages can principally be provided between the retracted position and the extended position, between which the adjusting screed is moved in relation to the connecting screed. It is also possible that the retracted position and the extended position are the only stages in which the adjusting screed can be moved. However, in order to make the adjustment of the adjusting screed as flexible as possible, it is preferred that the adjusting device is arranged in such a way that it can adjust the adjusting screed continuously between the retracted position and the extended position. In other words, the adjusting screed is not only adjustable between different predetermined positions or stages between the retracted and extended position, but can be brought to any desired position between the maximum retracted and maximum extended position. As a result, the paving width of the attachment screed unit and thus the entirety of the screed of the road paver can be adjusted in an especially flexible way to the respective requirements.

Since the adjustment of the adjusting screed often needs to occur in an especially precise manner, it is preferred if an operator can check the lateral progression of the paved area on the side of the screed or attachment screed unit situated transversely in the working direction and can adjust it to the current requirements. It is, therefore, advantageous if the attachment screed unit according to the present invention comprises an operator control device, via which an operator can set the paving width of the attachment screed unit, and optimally directly on the attachment screed unit itself. An operator standing directly adjacent to the attachment screed unit or walking adjacent thereto can activate the adjusting device via the operator control device and can adjust the adjusting screed either in the direction of the retracted or extended position in relation to the connecting screed and thus vary the paving width of the attachment screed unit. The operator control device is a control panel, for example, on which control elements are situated. For the purpose of supplying the operator control device with electric power, it preferably uses the same power source as the adjusting device, i.e., for example, a battery arranged on the attachment screed unit according to the present invention.

The attachment screed unit according to the present invention is thus exclusively provided for attachment to an already existing screed which is connected to the tractor of the road paver, usually via retaining arms, for example, a basic screed and optionally one or several attachment screeds. Especially when only rigid screeds, either in form of a basic screed or in addition also as individual attachment screed segments, are used, variability in the paving width is thus achieved by the attachment of the attachment screed unit according to the present invention, which, in addition, can be installed in a simple manner.

In order to enable the attachment of the attachment screed unit according to the present invention to a screed of the road paver, it is preferred if the connecting screed comprises an attachment device, via which the attachment screed unit can be attached to a screed, especially a rigid screed, of a road paver. The attachment device is thus preferably arranged on a face end transversely to the working direction of the attachment screed unit in order to enable a face end connection of the attachment screed unit for mounting. By attaching an attachment screed unit according to the present invention, the total paving width of the entire screed unit of a road paver is thus not only extended, but it also becomes variably adjustable with respect to its paving width transversely to the working direction.

The attachment device can principally comprise protruding fixing bolts and/or openings for accommodating screwed connections and/or respective fixing bolts. The additional or alternative use of a hitching apparatus has however proven to be especially preferred, specifically with at least one engagement hook protruding beyond the face end of the mounting side of the attachment screed unit. The engagement hook is arranged for threading and engaging behind the screed arranged on the road paver, especially a rigid screed. Mounting can thus be facilitated considerably and the mounting time can be kept short. It is thus ideal if the fastening device is part of a mechanically actuatable quick-action connection, e.g., a latch or snap connection, which can ideally be opened and closed entirely without any external tools.

The present invention also relates to a road paver with an attachment screed unit as described above. All features and advantages which have been described for the attachment screed unit can also be applied to the road paver having said attachment screed unit. It is an essential advantage of the present invention that the hydraulic fluid of the hydraulic system of the road paver (tractor) is separate from the hydraulic fluid of the electro-hydraulic unit and is thus not subjected to increased contamination by repeated connection or disconnection of a hydraulic connection of the attachment screed unit. Both space in the screed and also material and thus costs are saved by dispensing with hydraulic lines. Furthermore, the present invention allows obtaining an adjustment of the paving width in a simple manner by the attachment of the attachment screed unit according to the present invention, even in the case of road pavers equipped with rigid screeds, especially in the case of large paving widths, without having to carry out complex modification work on the road paver. The required modification measures are reduced to a minimum by the autonomous functionality of the electro-hydraulic unit, for the operation of which either no additional power supply or only the provision of an electric connection is required.

According to the present invention, the attachment screed unit is used for widening in addition to an already existing screed, especially a rigid screed, of the road paver. The screed that already exists on the road paver can consist either of a basic screed or additionally also of one or several attachment screeds without paving width adjustment. In order to ensure that the attachment screed unit according to the present invention can be mounted on a screed of the road paver, it is preferred if the connecting screed of the attachment screed unit comprises an attachment device, via which it can be attached to an end of a screed or a screed element of the road paver which is situated transversely to the working direction. This attachment device, which has already been described in closer detail above, is preferably situated on a face end of the connecting screed, specifically the face end ("inner face end") facing the central line extending in the working direction of the road paver. As a result, the connecting screed can thus be attached as a paving width extension on the face end to a screed unit of the road paver, thus enabling stable and resilient mounting of the attachment screed unit according to the present invention.

The road paver preferably comprises two attachment screed units according to the present invention, a respective attachment screed unit being arranged on an end of the existing screed of the road paver which is situated transversely to the working direction. In this manner, the total paving width of the road paver can be adjusted to the respective working conditions by an adjustment of the paving width of the attachment screed units according to the present invention, in particular, independently of each other, on both sides. Furthermore, a relatively constant distribution of weight of the entire screed device can be obtained on both sides of the paving width.

Generic road pavers or their tractors usually comprise an electrical on-board network, via which all electrical consumers of the road paver are supplied with electric power. For the supply of the electro-hydraulic unit of the attachment screed unit according to the present invention with electrical power, the electro-hydraulic unit therefore comprises a connection for the electrical connection with an on-board network of the road paver or the tractor. A purely electrical contact of the electro-hydraulic unit with the on-board network of the tractor is both cost-effective and also easier to achieve than the hydraulic integration of the actuator of the electro-hydraulic unit in the hydraulic system of the tractor. This can be achieved, for example, via a power cable, which more particularly is unrolled from a cable drum on the attachment screed unit and is connected to a connection on the tractor. It is, however, also possible and included in the present invention if the attachment screed unit according to the present invention carries an electrical energy storage unit of its own, for example, in form of a battery. In this case, it is only necessary to provide mechanical mounting of the attachment screed unit on a screed connected directly (via the basic screed) or indirectly (on an intermediate screed) to the road paver.

BRIEF DESCRIPTION OF THE DRAWINGS

The present invention will be explained below in closer detail by reference to the exemplary embodiments shown in the schematic drawings, in which.

Like components are designated by like reference numerals. Components that are repeated are not designated separately in each drawing.

DETAILED DESCRIPTION OF THE INVENTION

Figure 1:
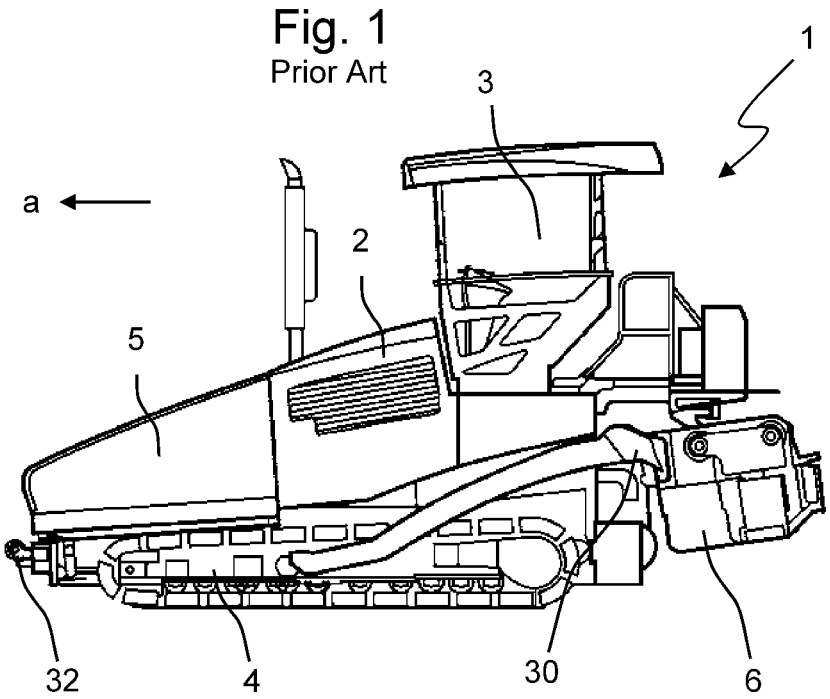
Fig. 1 Prior Art
FIG. 1 shows a side view of a road paver.

FIG. 1 shows a generic road paver 1 with a machine frame or chassis 2 and an operator platform 3. The road paver 1 further comprises an internal combustion engine (not shown), for example, a diesel engine, by means of which running gears 4 such as wheels or, as shown here, crawler tracks are driven via a suitable hydraulic system on the tractor. In working operation of the road paver 1, it lays and paves paving material in a layer in the working direction a, for example, for a road. To this end, the road paver 1 pushes with a push roller 32 a transport vehicle (not shown) in front of it, which is a dump truck, for example. The latter tips hot asphalt into the bunker or bucket 5 of the road paver 1. From the bunker 5, the asphalt is transported via scraper floors (not shown) through the tunnel situated in the interior of the road paver 1 to the rear and to the screed 6. The screed 6 on the illustrated road paver is in a lifted transport position. In working operation, the screed 6 is lowered toward the ground to be processed and floats on the material to be paved. The asphalt is distributed over the entire width of the screed 6 transversely to the working direction a, and is pre-compacted and smoothed by it. The pre-compacted asphalt layer is usually further compacted by road rollers (not shown) travelling behind the road paver until a complete, stable road surface has been produced.

Figure 2:
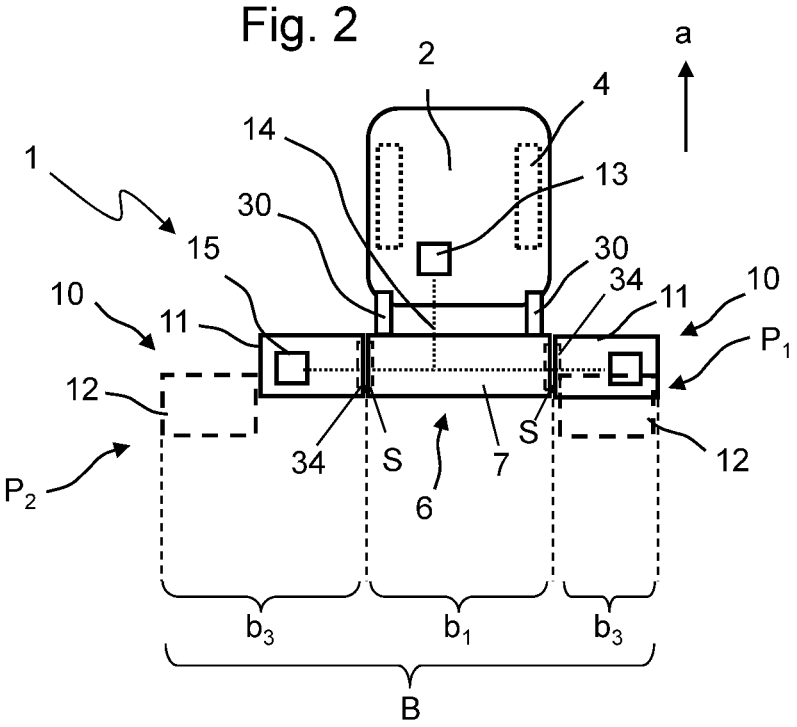
FIG. 2 shows a top view of a road paver having two attachment screed units according to a first embodiment.
Figure 3:
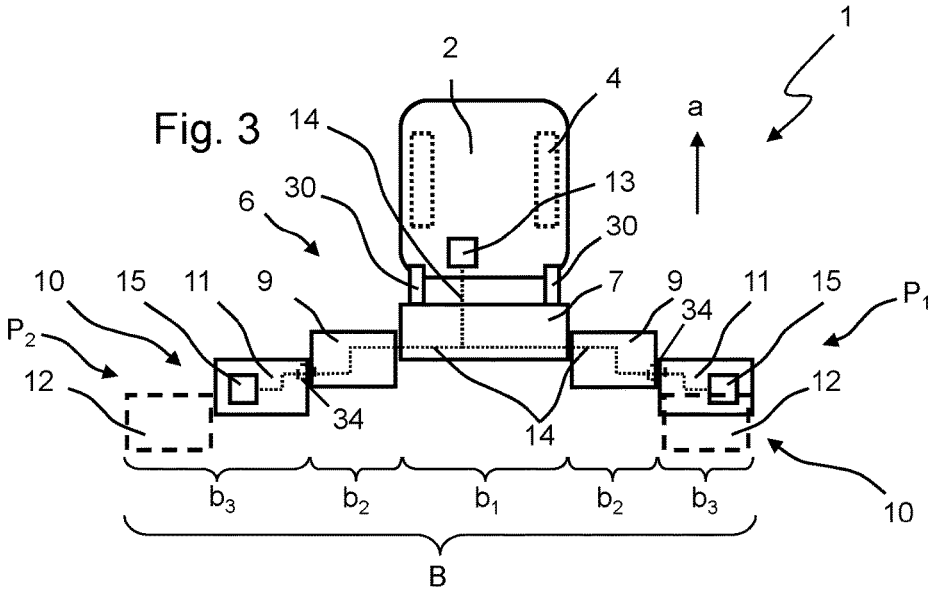
FIG. 3 shows a top view of a road paver having two attachment screed units according to a second embodiment.
Figure 4:
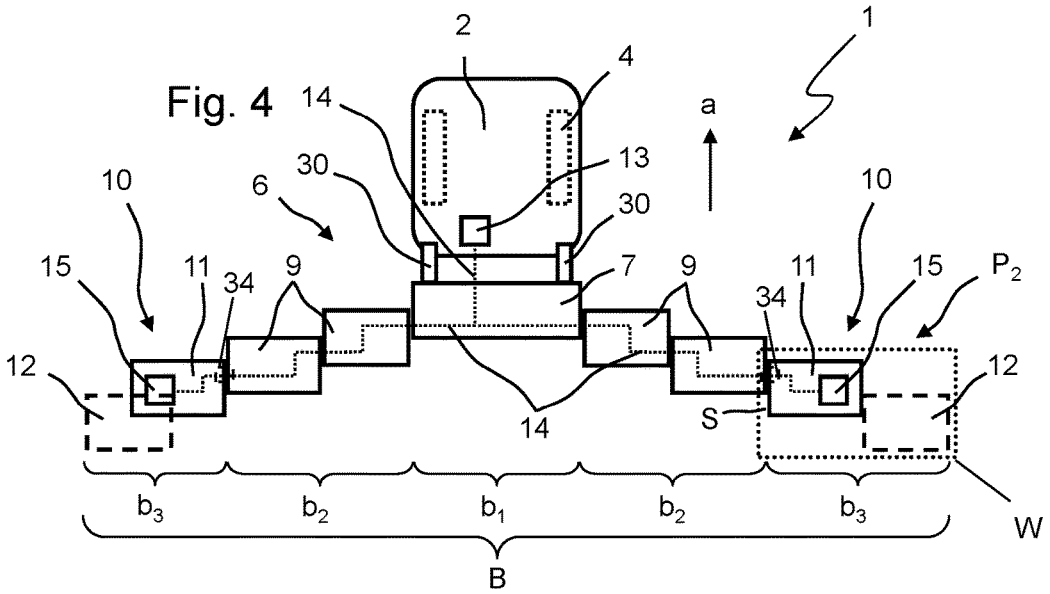
FIG. 4 shows a top view of a road paver having two attachment screed units according to a third embodiment.

FIGS. 2 to 4 respectively show a top view of a road paver 1. The essential aspect in this case is that the road paver initially comprises a basic screed 7 which is arranged as a rigid screed, i.e., a screed without paving width adjustment, and which is fixed via towing arms 30 to the machine frame or the chassis 2 of the road paver 1. Attachment screed units 10 are attached directly or indirectly on the respective face ends, i.e., transversely to the working direction a, to said basic screed 7 in the different embodiments according to FIGS. 2 to 4. An attachment screed unit 10, which is arranged as an attachment module or attachment unit, respectively comprises a connecting screed 11 and an adjusting screed 12 which is mounted on the connecting screed 11 so as to be movable or adjustable horizontally and transversely to the working direction a, for example, by means of a three-point mounting system known in the art. The adjusting screeds 12 can be adjusted from the retracted position $P_1$ to the extended position $P_2$ on the connecting screed 11. As a result of the adjustment of the adjusting screeds 12, the paving width $b_3$ of the attachment screed unit 10 is adjusted in a freely selectable manner between the two illustrated extreme positions $P_1$, $P_2$. The paving width $b_3$ of the attachment screed unit 10 is smallest in the retracted position $P_1$ and substantially corresponds to the paving width of the connecting screed 11. In the extended position $P_2$ of the adjusting screed 12 which is shown in FIG. 3, the paving width $b_3$ of the attachment screed unit 10 is greatest and substantially corresponds to the paving width of the connecting screed 11 plus the respective paving widths of the adjusting screed 12.

The adjustment of the adjusting screeds 12 on the connecting screeds 11 transversely to the working direction a is respectively produced by an adjusting device which according to the present invention comprises an electro-hydraulic unit 15. The precise configuration of the adjusting device will be explained below in closer detail. As shown in the embodiment of FIG. 2 with respect to the power supply, the basic screed having a fixed paving width $b_1$ is connected via the towing arms 30 to the machine frame of the tractor of the road paver. The basic screed is provided with a receptacle device on the face ends S of the basic screed 7 transversely to the working direction a, via which the connecting screeds 12 can be connected to the basic screed 7, preferably in a purely mechanical manner. The attachment device 16 is provided for this purpose on the face end of the connecting screed. The entire connection between the connecting screed 11 and the basic screed 7 is designated with reference numeral 34. The electro-hydraulic unit 15 of each attachment screed unit 10, which is arranged on the connecting screed 11, is respectively connected via an electric line 14 such as a cable to the on-board network 13 of the road paver 1 or its tractor. The electric line 14 is arranged in a space-saving manner in a cable drum on the attachment screed unit 10 and can be unrolled from said drum for the connection to the on-board network 13 in a rapid and uncomplicated manner. In FIG. 2, the attachment screed unit 10 which is on the right side as seen in the working direction a is in its retracted P1 position with minimal paving width, while the left attachment screed unit 10 is in its extended P2 position with maximum paving width. FIG. 2 thus illustrates that the total paving width B can be varied within a specific range by an adjustment of the adjusting screed 12 on the connecting screed 11. No hydraulic connection or other complex installation of the attachment screed units is necessary. Instead, it is only necessary to provide the mechanical coupling of the attachment screed units 10 with the rigid screed 7.

In the embodiment according to FIG. 3, the basic screed 7 (a rigid screed in this case) is also fixed via the towing arms 30 to the machine frame or chassis 2 of the road paver 1. In order to extend the paving width $b_1$ of the basic screed 7, extensions (intermediate screeds) in form of rigid attachment screeds 9 are mounted on its face ends situated transversely to the working direction a. They have an attachment screed width $b_2$ by which the paving width $b_1$ of the basic screed 7 is extended. In the embodiment of FIG. 3, a mechanical attachment screed 9 is respectively fixed to the ends of the basic screed 7 which are situated transversely to the working direction a, whereas in the embodiment of FIG. 4 further attachment screeds 9 are fixed to the outer ends of the attachment screeds 9 which are situated transversely to the working direction a. A respective attachment screed unit 10 is connected via the connecting screed 11 to the attachment screed units 10 at the ends of the attachment screeds 9 having fixed paving widths, which ends are situated on the outside transversely to the working direction a. The paving width $b_3$ of the attachment screed unit 10 here also additionally increases the total screed width B, which is composed of the paving width $b_1$ of the basic screed 7, the paving width $b_2$ of the, in particular, mechanical, attachment screeds 9, and the paving width $b_3$ of the attachment screed units 10. The total screed width B can be adjusted to the respective operating requirements by varying the paving width $b_3$ of the attachment screed unit 10, i.e., by adjusting the adjusting screed 12 relative to the connecting screed 11.

Since a respective attachment screed unit 10 is arranged on both sides or ends of the screed 6 which are situated transversely to the working direction a, an adjustment of the total screed width B can also be made asymmetrically. This is shown in FIG. 3, for example, in which the adjusting screed 12 of the attachment screed unit 10 which is situated on the right side in the working direction a is in the retracted position $P_1$, whereas the adjusting screed 12 of the attachment screed unit 10 which is situated on the left side as seen in the working direction is situated in the extended position $P_2$. In the embodiment of FIG. 4, however, the attachment screed unit 10 or its adjusting screed 12 which is situated on the right side as seen in the working direction a is in the extended position $P_2$, whereas the attachment screed unit 10 or its adjusting screed 12 which is situated on the left side as seen in the working direction a is situated in a freely selected intermediate position between the maximum retracted position $P_1$ and the maximum extended position $P_2$. The electric lines 14 or cables for the electro-hydraulic units 15 of the respective attachment screed units 10 are laid through the attachment screeds 9 and the basic screed 7 up to the connection with the on-board network 13 of the road paver 1. Especially FIGS. 3 and 4 illustrate the considerable installation advantage which is achieved by the use of the attachment screed units 10 according to the present invention. Since the attachment screed units 10 merely require supply with electrical power for maintaining their functionality (which can also be provided by battery on the attachment screed unit 10 itself), the installation effort is very low and is limited to the mechanical connection via the connecting screed 11 on the one hand and, if necessary, the laying of an electric line to the on-board network of the tractor on the other hand. Consequently, no special precautions need to be taken for the installation on the basic screed 7 or the attachment screeds 9. The attachment screed units 10 according to the present invention merely need to be "attached" and still allow sufficient variability of the total paving width.

Figure 5:
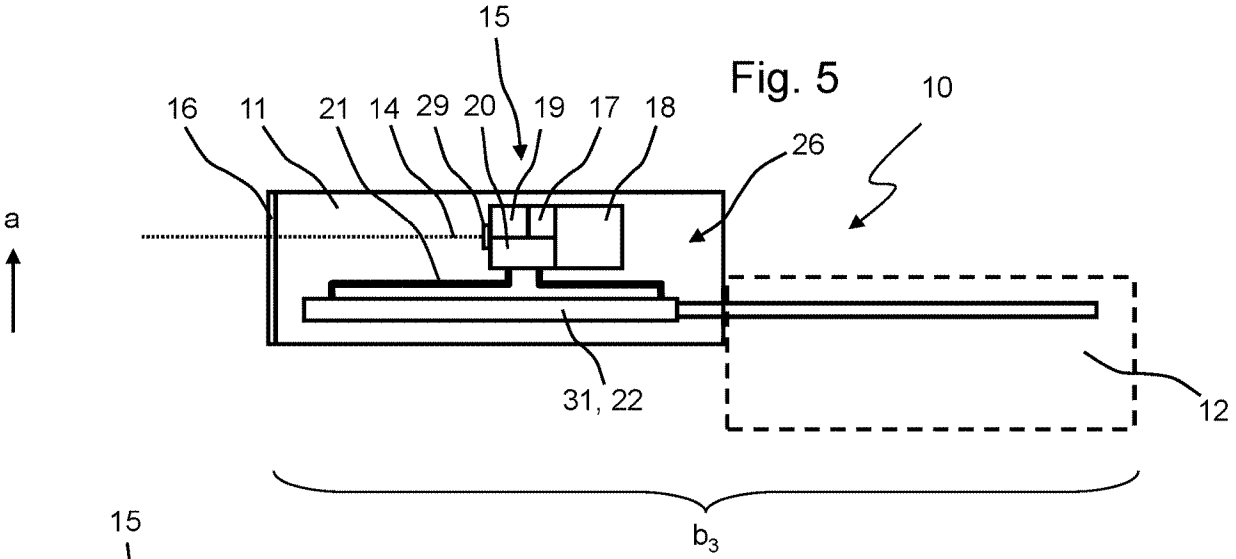
FIG. 5 shows a top view of an attachment screed unit according to a third embodiment.
Figure 6:
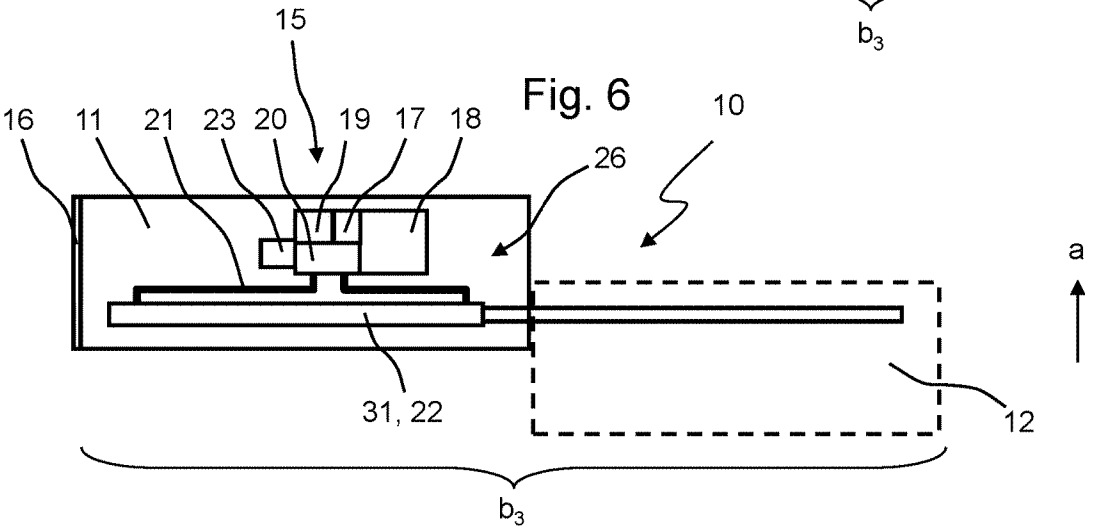
FIG. 6 shows a top view of an attachment screed unit according to an alternative embodiment.
Figure 7:
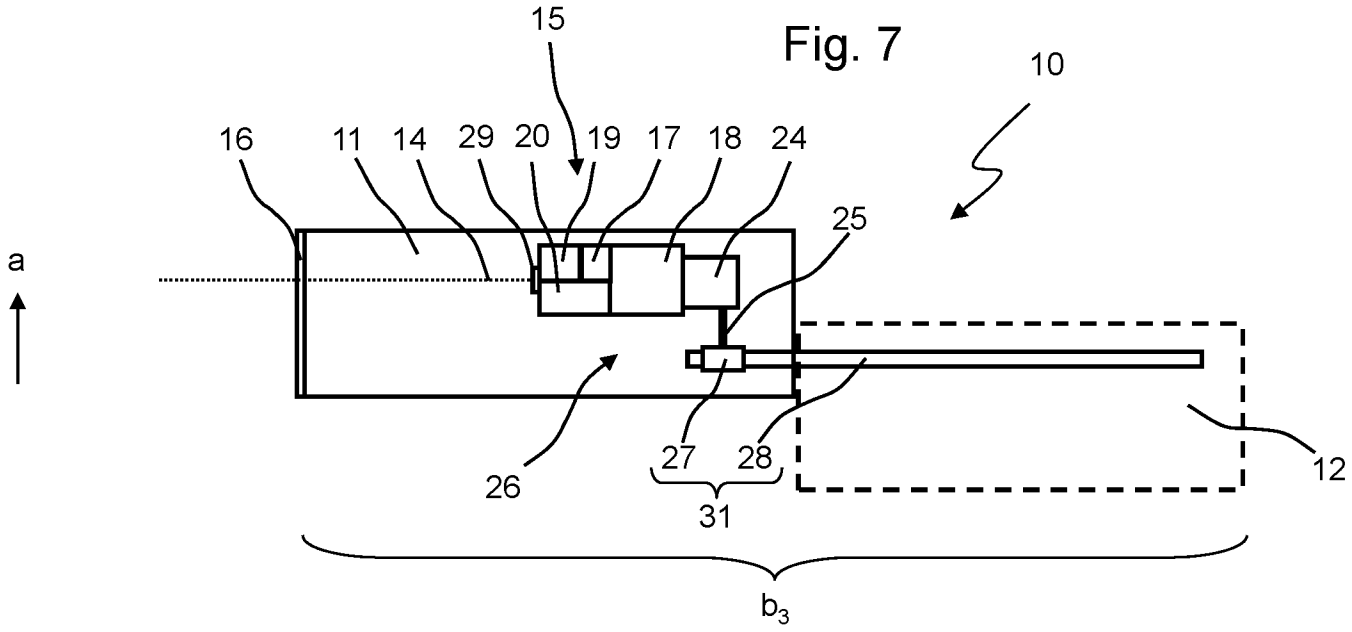
FIG. 7 shows a top view of an attachment screed unit according to a further alternative embodiment.

FIGS. 5, 6 and 7 show individual embodiments of the attachment screed units 10 according to the sector W of FIG. 4 in detail and also apply similarly to the embodiments shown in FIGS. 2 and 3 with respect to the configuration and the function of the electro-hydraulic unit 15, in particular. It is a common feature of all embodiments that the adjusting screed 12 is situated in the extended position $P_2$. An attachment device 16 is provided on the connecting screed 11 on the face end or on its narrow side in the horizontal plane, which attachment device is situated on the side of the connecting screed 11 beyond which the adjusting screed 12 cannot be moved, or which is opposite of the side beyond which the adjusting screed 12 can be adjusted relative to the connecting screed 11. The attachment device 16 is arranged in such a way that the connecting screed 11 and thus the attachment screed unit 10 can be attached via said attachment device either to a basic screed 7 or a mechanical attachment screed 9 for widening the entire screed width B. This can occur, for example, via screwed connections, retaining bolts, retaining hooks or similar elements. FIGS. 5, 6 and 7, respectively, disclose different details concerning the configuration of the electro-hydraulic unit 15 and the adjusting device 26 with the actuator 31.

FIG. 6 shows an electro-hydraulic unit 15 with a fluid reservoir 18, an electric motor 19 for a hydraulic pump 20 and an electric connection 29, via which the electro-hydraulic unit 15 is connected to the electric line 14 and the on-board network 13 of the road paver 1. The electric motor 19 and the hydraulic pump 20 which is driven by the electric motor can also especially be arranged as a modular unit, so that the electric motor 19 is a part of the hydraulic pump 20. The electric motor 19 drives the hydraulic pump 20, which conducts the hydraulic fluid from the fluid reservoir 18 via the hydraulic lines 21 to the actuator 31, which in this case is a double-acting hydraulic cylinder 22, and pressurizes the same with hydraulic fluid. The hydraulic cylinder 22 connects the connecting screed 11 to the adjusting screed 12. The hydraulic cylinder 22 is either retracted or extended by pressurisation of the hydraulic cylinder 22 with hydraulic fluid by the hydraulic pump 20, and the adjusting screed 12 is thus adjusted between the retracted position $P_1$ and the extended position $P_2$.

Furthermore, the attachment screed unit 10 comprises a highly schematically indicated operator control device 17 such as a control panel, via which an operator can control the adjustment of the adjusting screed 12. The adjustment of the adjusting screed 12 of the attachment screed unit 10 can be controlled directly by the operator on the operator control device 17 and is independent of other factors such as further attachment screed units 10 and the adjusting position of their adjusting screeds 12. It is thus possible for the operator to control the attachment screed unit 10 or the adjusting screed 12 of the attachment screed unit 10 according to the operating conditions directly present at the attachment screed unit 10 without having to consider other parts of the road paver 1.

While the electric connection 29 is used in FIG. 5 for electrical contact of the electro-hydraulic unit 15, for example, for supplying the electric motor 19 and the control device 17, with the on-board network 13 of the road paver 1, such contact is not necessary in the embodiment of FIG. 6. A power source 23 in form of a battery is provided in this case, through which the electro-hydraulic unit 15 and especially the electric motor 19 and the control device 17 is supplied with power or current. The electric connection 29 can be integrated in this case in the electro-hydraulic unit for connection with the battery. No current-conducting connection is therefore necessary between the electro-hydraulic unit 15 and the road paver 1. The attachment screed unit 10 merely needs to be fixed via the attachment device 16 to the screed 6 of the road paver 1. Furthermore, it is merely necessary to connect the compacting devices in the attachment screed unit 10, for example, the tamping beam and the vibrating smoothing screed, to the respective mechanical drives of the said devices of the screed 6, whereas no hydraulic or electrical transmission of power to the attachment screed unit 10 is necessary. The electro-hydraulic unit is completely autonomous and does not require any power-transmitting connection to the tractor of the road paver for the adjustment of the screed width. A modification of the screed 6, i.e., the attachment or removal of the attachment screed units 10 can thus occur in an especially rapid and simple way. The operation of the actuator 31 or hydraulic cylinder 22 in the embodiment of FIG. 7 corresponds to the embodiment of FIG. 5.

The embodiment of FIG. 7 shows an electro-hydraulic unit which is connected according to the embodiment in FIG. 5 via an electric connection 29 to the on-board network 13 of the road paver 1 or the tractor. The adjusting device 26 further comprises a hydraulic motor 24 which is driven by the hydraulic pump 20 and which supplies power in form of torque to a drive shaft 25. The drive shaft 25 transmits the torque to a rack-and-pinion drive 27 which utilises the torque in order to displace a toothed rack 28 transversely to the working direction a. The hydraulic motor 24 is arranged in reversible configuration, as a result of which the adjusting direction of the adjusting screed 12, i.e., the retraction or extension of the adjusting screed 12, can be controlled. It will be appreciated that other combinations of the power supply of the electro-hydraulic unit 15 with further embodiments of the actuator 31 as a linear drive can be considered. The advantages of the present invention are provided as long as the hydraulic adjustment of the adjusting screed 12 relative to the connecting screed 11 of the attachment screed unit 10 is separate from the hydraulic system of the road paver 1 (tractor), and the hydraulic fluid of the remaining hydraulic system of the road paver 1 (tractor) does not mix with the hydraulic fluid which is used for adjusting the adjusting screed 12 of the attachment screed unit 10.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. An attachment screed unit for attachment to a screed unit of a road paver, comprising:

a connecting screed;

at least one adjusting screed which is adjustably mounted on the connecting screed and which is adjustable between a retracted position ($P_1$) and an extended position ($P_2$) relative to the connecting screed, as a result of which the paving width ($b_4$) of the attachment screed unit is variable; and a hydraulic adjusting device, which is arranged in such a manner that it can adjust the at least one adjusting screed between the retracted position ($P_1$) and the extended position ($P_2$), the adjusting device comprising an electro-hydraulic unit which is arranged on the attachment screed unit and comprises an electric connection via which the electro-hydraulic unit can be supplied with electric power, and the electro-hydraulic unit comprising a separate hydraulic circuit which is independent of, and not fluidly connected to, the hydraulic circuit of the road paver, with the hydraulic circuit being located entirely on the attachment screed, and with the electro-hydraulic unit having at least one electrically driven hydraulic pump and a hydraulic actuator which is driven by the hydraulic pump.

2. The attachment screed unit according to claim 1, wherein the electro-hydraulic unit comprises a power source.

3. The attachment screed unit according to claim 1, wherein the actuator is a linear drive.

4. The attachment screed unit according to claim 1, wherein the adjusting device is arranged in such a manner that it can continuously adjust the adjusting screed between the retracted position ($P_1$) and the extended position ($P_2$).

5. The attachment screed unit according to claim 1, wherein the attachment screed unit comprises an operator control device operable to allow an operator to set the paving width ($b_4$) of the attachment screed unit.

6. The attachment screed unit (10) according to claim 1, wherein the connecting screed comprises on its face end an attachment device via which the attachment screed unit can be attached to a screed.

7. The attachment screed unit according to claim 6, wherein the attachment device comprises at least one fastening device on the face end of the connecting screed transversely to the working direction.

8. The attachment screed unit according to claim 7, wherein the fastening device comprises an engagement hook protruding beyond the face end.

9. The attachment screed unit according to claim 7, wherein the fastening device is a part of a quick-action connection that can be actuated mechanically.

10. A road paver having a screed unit and at least one attachment screed unit according to claim 1 which is mounted on the screed unit.

11. The road paver according to claim 10, wherein a respective attachment screed unit is directly arranged on each of the face ends of the screed unit situated opposite each other transversely to the working direction.

12. The road paver according to claim 10, wherein the at least one connecting screed of the attachment screed unit is connected to a rigid screed of the road paver via at least one intermediate screed.

13. The road paver according to claim 10, wherein a connection device is provided on the road paver via which an electric connection is provided for the connection of the attachment screed.

14. The attachment screed unit of claim 2, wherein the power source comprises a battery.

15. The attachment screed unit of claim 7, wherein the linear drive comprises a double-acting hydraulic cylinder or a rack-and-pinion drive.

* * * * *